US006517380B1

(12) United States Patent
Deutsch

(10) Patent No.: US 6,517,380 B1
(45) Date of Patent: Feb. 11, 2003

(54) MARINE ON-BOARD CHARGER INLET

(75) Inventor: Peter K. Deutsch, Novato, CA (US)

(73) Assignee: Marinco, Napa, CA (US)

( * ) Notice: Subject to any disclaimer, the term of this patent is extended or adjusted under 35 U.S.C. 154(b) by 0 days.

(21) Appl. No.: 10/112,329

(22) Filed: Mar. 27, 2002

(51) Int. Cl.[7] ..... H01R 13/40
(52) U.S. Cl. ..... 439/598
(58) Field of Search ..... 439/598, 551, 439/141, 142, 337, 558, 357

(56) References Cited

U.S. PATENT DOCUMENTS 3,675,184 A * 7/1972 Vetter ..... 439/462
4,037,907 A * 7/1977 Klimek et al. ..... 439/142
4,062,611 A * 12/1977 Carlsson et al. ..... 361/826
4,106,834 A * 8/1978 Horowitz ..... 439/142
4,629,269 A * 12/1986 Kailus ..... 439/587
6,126,474 A * 10/2000 Doye et al. ..... 439/350

* cited by examiner

*Primary Examiner*—Tulsidas Patel
*Assistant Examiner*—Phuong K T Dinh
(74) *Attorney, Agent, or Firm*—Thomas R. Lampe

(57) ABSTRACT

A marine on-board charger inlet includes a housing having a circular-shaped rib within the housing interior which is received in a recess located at the front end of an electrical plug. The front end of the plug is planar and is aligned with a planar surface of the rib. This enables conventionally sized electrical prongs to be utilized and the plug to be used in the manner of a conventional electrical plug. A lock tab integral with the housing cooperates with a detent on the plug to maintain the housing and plug together.

1 Claim, 4 Drawing Sheets

MARINE ON-BOARD CHARGER INLET

TECHNICAL FIELD

This invention relates to a marine electrical connector, more particularly to a marine on-board charger inlet.

BACKGROUND OF THE INVENTION

The use of marine on-board charger inlets is well known. Such devices are normally attached to structure of a boat such as a wall or bulkhead. A conventional prior art inlet includes a housing which receives and retains an electrical plug having electrical prongs or contacts which are engaged by a receptacle pushed into position in the housing from a side of the bulkhead or other structure.

As will be seen below, a commonly employed marine on-board charger inlet currently employed incorporates an integral partition within the interior of the housing between the ends of the housing. The front end of the plug body of the electrical plug engages the partition and the electrical prongs pass through openings in the partition for engagement by a receptacle in the housing interior. Such an arrangement requires that the electrical prongs be longer than those of an ordinary electrical plug since the thickness of the inner partition must be taken into account when providing an interconnection between the electrical plug and the receptacle. Thus, the electrical plug cannot be utilized in other applications with conventional receptacles as a normal electrical plug.

Another feature of the commonly used prior art marine on-board charger inlet is that it employs a spring biased metal lock element on the plug which is used to provide a releasable interconnection between the plug and the housing. Such an arrangement is prone to corrosion which can interfere with proper operation of the lock.

DISCLOSURE OF INVENTION

The present invention relates to a marine on-board charger inlet which is characterized by its relative simplicity, ease of use and reliability in even extreme marine conditions.

The marine on-board charger inlet includes a housing having first and second housing open ends and a cylindrically-shaped inner wall defining a housing interior extending between the first and second housing open ends.

A circular-shaped rib is attached to the housing and extends inwardly from the cylindrically-shaped inner wall between the first and second housing open ends.

An electrical plug is incorporated in the marine onboard charger inlet which includes a plug body having a front end and electrical prongs projecting from the front end. The plug body projects into the first housing open end and frictionally engages the cylindrically-shaped inner wall of the housing.

The plug body has a circular-shaped recess adjoining and extending rearwardly from the front end receiving the circular-shaped rib and cooperable therewith to prevent movement of the electrical plug in the direction of the second housing open end. The electrical prongs are positioned within the housing interior and spaced inwardly from the cylindrically-shaped inner wall and inwardly of the second housing open end.

Lock means releasably locks the plug body in engagement with the circular-shaped rib and retains the electrical plug in the housing.

Other features, advantages and objects of the present invention will become apparent with reference to the following description and accompanying drawings.

MODES FOR CARRYING OUT THE INVENTION

Figure 1:
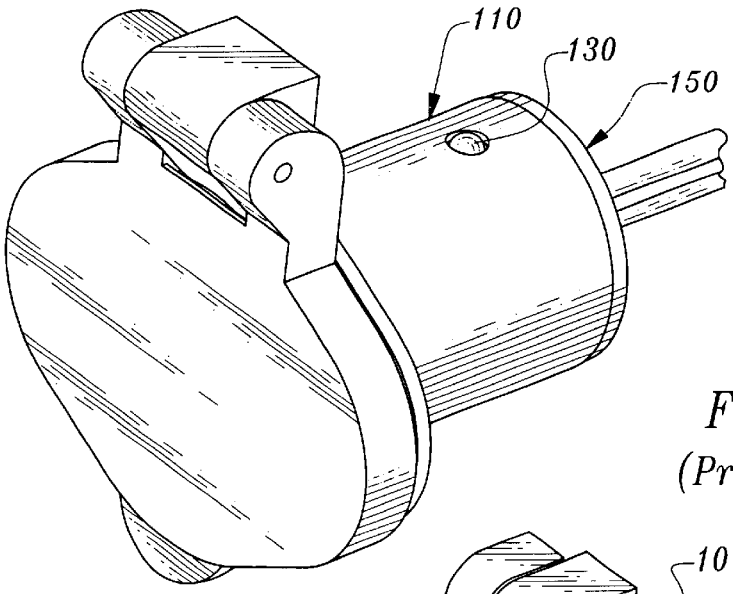
Fig. 1 (Prior Art)
FIG. 1 is a perspective view of a prior art marine on-board charger inlet.
Figure 2:
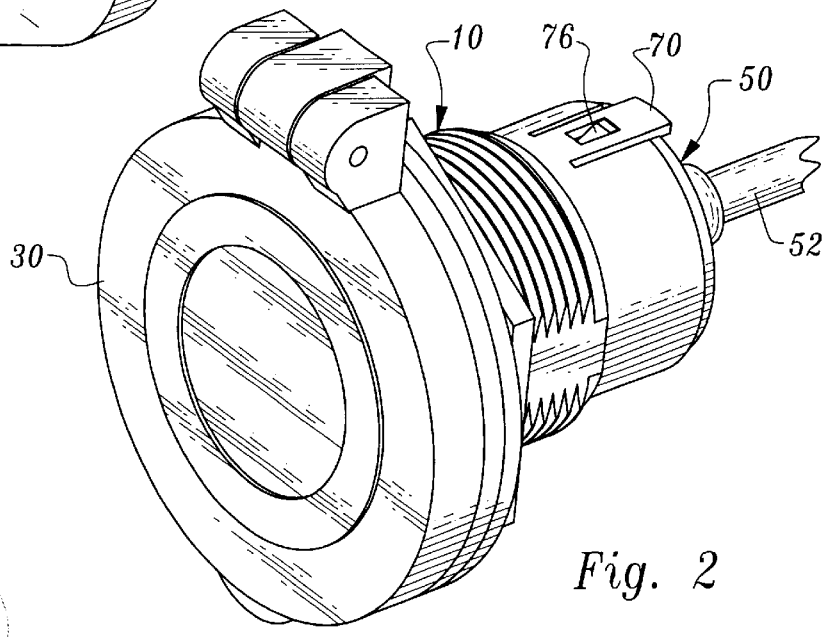
FIG. 2 is a perspective view of a first embodiment of a marine on-board charger inlet constructed in accordance with the teachings of the present invention.

Referring now to FIGS. 2, 5, 7A and 7B, a preferred form of marine on-board charger inlet constructed in accordance with the teachings of the present invention is illustrated. The device includes a molded plastic housing 10 having housing open ends 12, 14. The housing has a cylindrically-shaped inner wall 16 defining a housing interior extending between housing open ends 12, 14.

In this embodiment of the invention, the housing 10 has screw threads 18 formed thereon. These screw threads are employed with a threaded nut 20 to secure the housing 10 to a bulkhead 22, the housing projecting through a hole 24 in the bulkhead. The nut 20 is disposed on one side of the bulkhead and a flange 26 of the housing on the other side.

In the embodiment of the invention under discussion, a gasket 28 is disposed between the bulkhead 24 and the flange 26 of the housing, the gasket being in direct engagement with the bulkhead to provide a seal.

The housing 10 in this embodiment is employed in association with a cover cap assembly which is employed to cover housing open end 12 when the device is not in use. In particular, the cover assembly includes a cover 30 hingedly connected to a cover holder 32, the latter being positioned between the flange 26 and gasket 28 and positioned about the threaded end of the housing. Closure or cover 30 is hingedly connected to cover holder 32 by a hinge pin 34. A coil spring 36 biases the cover to the closed position shown in FIG. 7A. A resilient seal element 38 is disposed within the confines of cover 30.

A circular-shaped rib 40 is integral with the housing and extends inwardly from the inner wall 16 between the open ends 12, 14. The rib 40 has a planar outer rib surface oriented towards the housing open end 14. The housing interior is unobstructed between the rib 40 and open end 14.

Another component of the marine on-board charger inlet is an electrical plug 50 having wiring 52 attached to the rear end thereof. Plug 50 includes a plug body 54 having a front end 56 and electrical prongs 58, 60, 62 projecting from the front end. The plug body 54 projects into housing open end 12 and frictionally engages the cylindrically-shaped inner wall of the housing.

The plug body 54 has a circular-shaped recess 64 adjoining and extending rearwardly from the planar front end 56 of the plug body.

The recess 64 receives the circular-shaped rib 40 and is cooperable therewith to prevent movement of the electrical plug upon engagement therebetween in the direction of the housing open end 14. When the recess receives the rib, the electrical prongs are positioned within the housing interior and spaced inwardly from the cylindrically-shaped inner wall 16 and inwardly of the housing open end 14. The rib 40 has a planar outer rib surface 66 oriented toward the housing open end 14. The planar front end of the plug body is aligned with the planar outer rib surface. The front end 56 of the plug body is unobstructed by the housing, the housing interior, as previously stated, being unobstructed between the rib 40 and the open end 14. The circular-shaped recess 64 and the circular-shaped rib 40 are of equal dimension in the axial or longitudinal direction of the marine on-board charger unit.

Lock means of a specified character releasably locks the plug body in engagement with the circular-shaped rib and retains the electrical plug in the housing. More particularly, the lock means comprises a deformable lock tab 70 having an elastic memory normally maintaining the lock tab at the position shown in FIGS. 5 and 7A. The lock tab is integral with the housing. Suitably, the housing and lock tab are formed of molded plastic material of any suitable type.

Figure 7B:
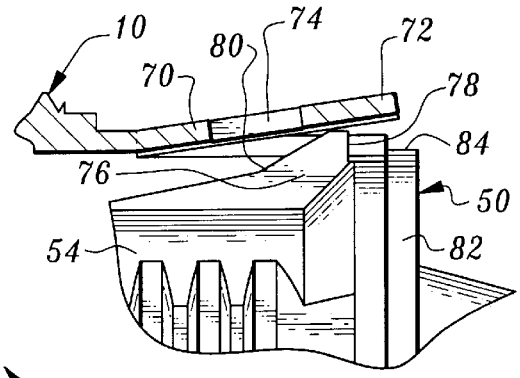
FIG. 7B is an enlarged view in partial cross-section illustrating the portion of the unit delineated by double-headed arrow 7B—7B in FIG. 7A and showing deformation of a lock tab integrally attached with the housing.
Figure 7A:
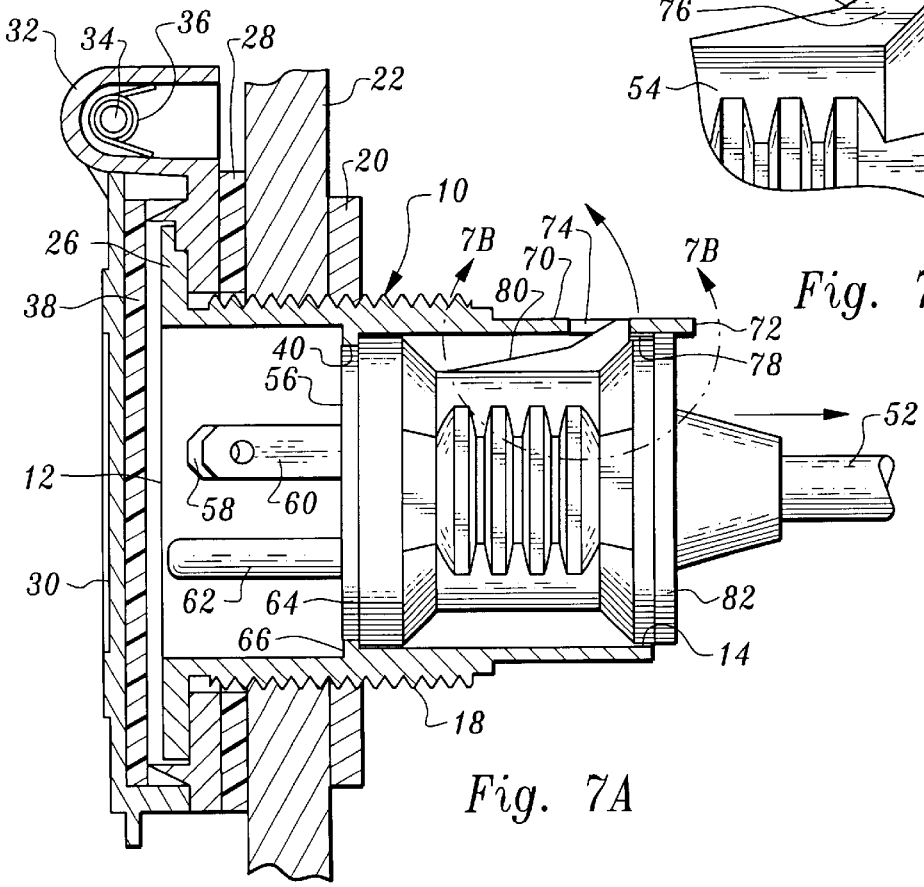
FIG. 7A is a view similar to that of FIG. 6A, but illustrating the embodiment of the invention shown in FIG. 2.

The lock tab has a distal lock tab end 72 projecting rearwardly beyond the housing open end 14. The lock tab defines a rectangular-shaped lock tab opening 74 adjacent to the distal tab end. The electrical plug 50 includes a detent 76 which includes a lock detent wall 78 lockingly engaging the lock tab and located within opening 74. The detent further includes an inclined detent wall 80 adjacent to the lock detent wall and angularly disposed relative thereto for engaging the lock tab and deflecting the distal lock tab end outwardly away from the housing when the plug and the housing are in engagement and moved toward one another to provide an interconnection therebetween. To disengage the lock tab from the detent, the user simply applies an upward pressure on distal lock tab end 72 as shown in FIG. 7B so that the detent clears the opening and end 72. When connecting the plug and housing, movement of the plug toward the housing will cause the lock tab to cam upwardly on the detent until the detent reaches the opening 74 and the lock tab returns to its normal position.

Electrical plug 50 further includes a rear flange 82 which covers the housing open end 14. The rear flange 82 defines an indent 84 receiving the lock tab to further stabilize the connection between the housing and the plug. The distal lock tab end extends rearwardly of the rear flange so that it can be readily accessed by a user's finger.

Figure 3:
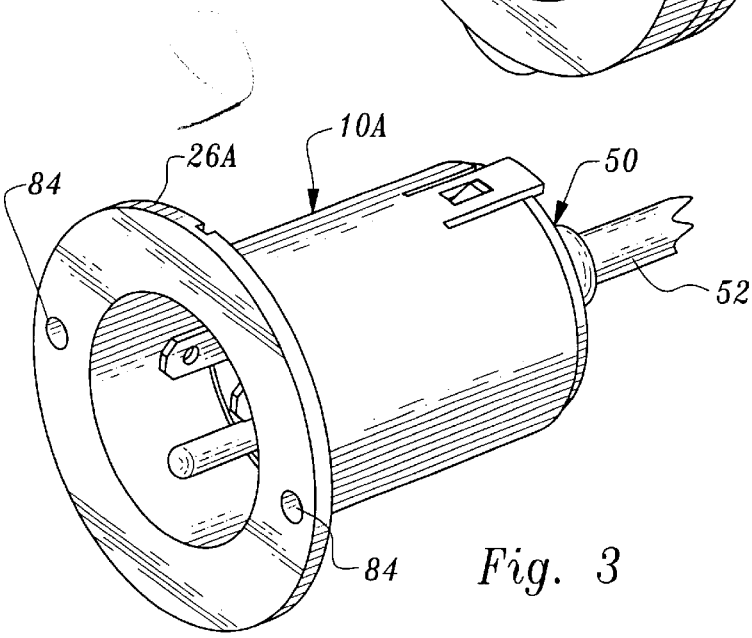
FIG. 3 is a perspective view of a second embodiment of marine on-board charger inlet constructed in accordance with the teachings of the present invention.
Figure 4:
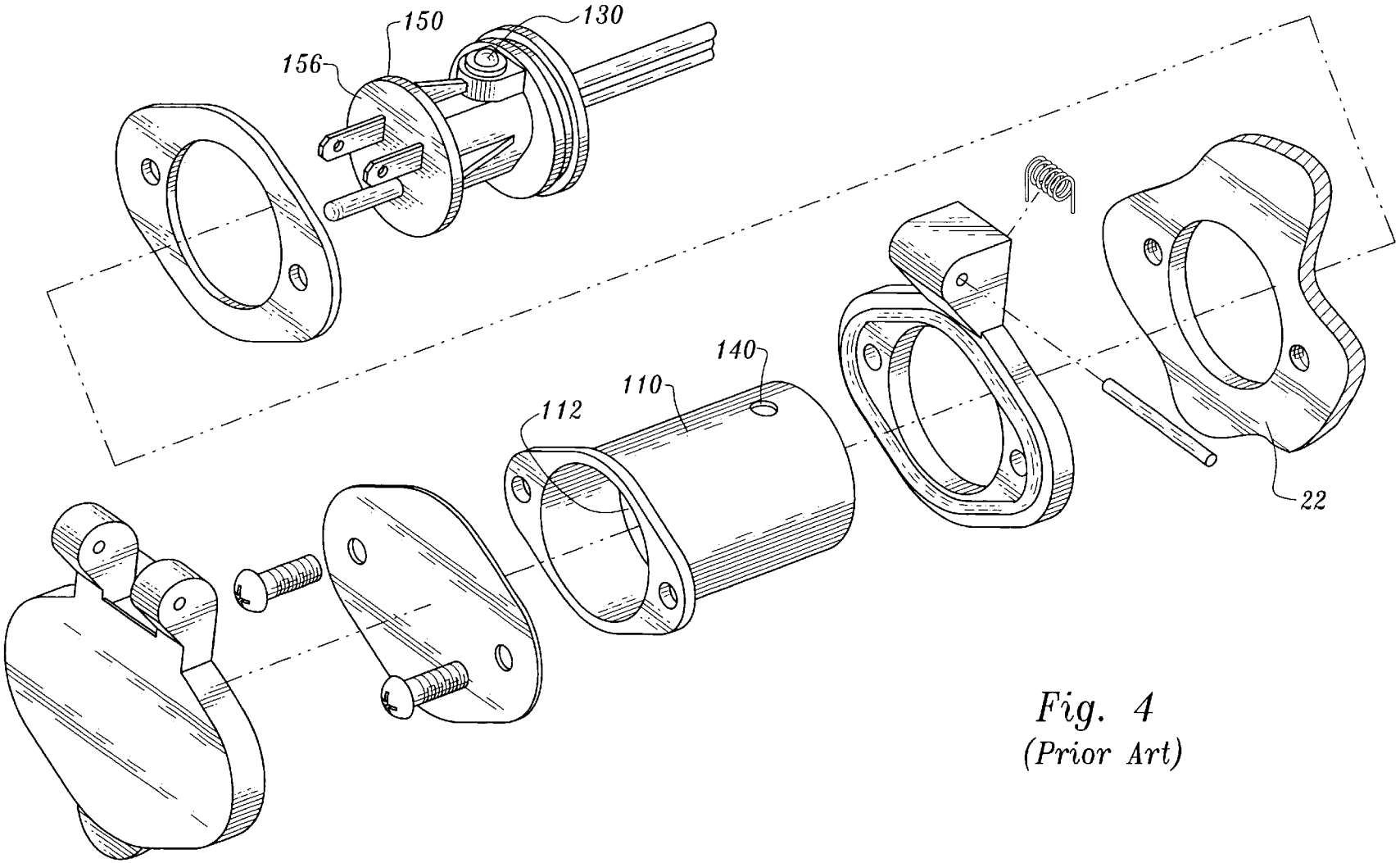
Fig. 4 (Prior Art)
FIG. 4 is an exploded view of the prior art marine on-board charger inlet shown in FIG. 1.
Figure 5:
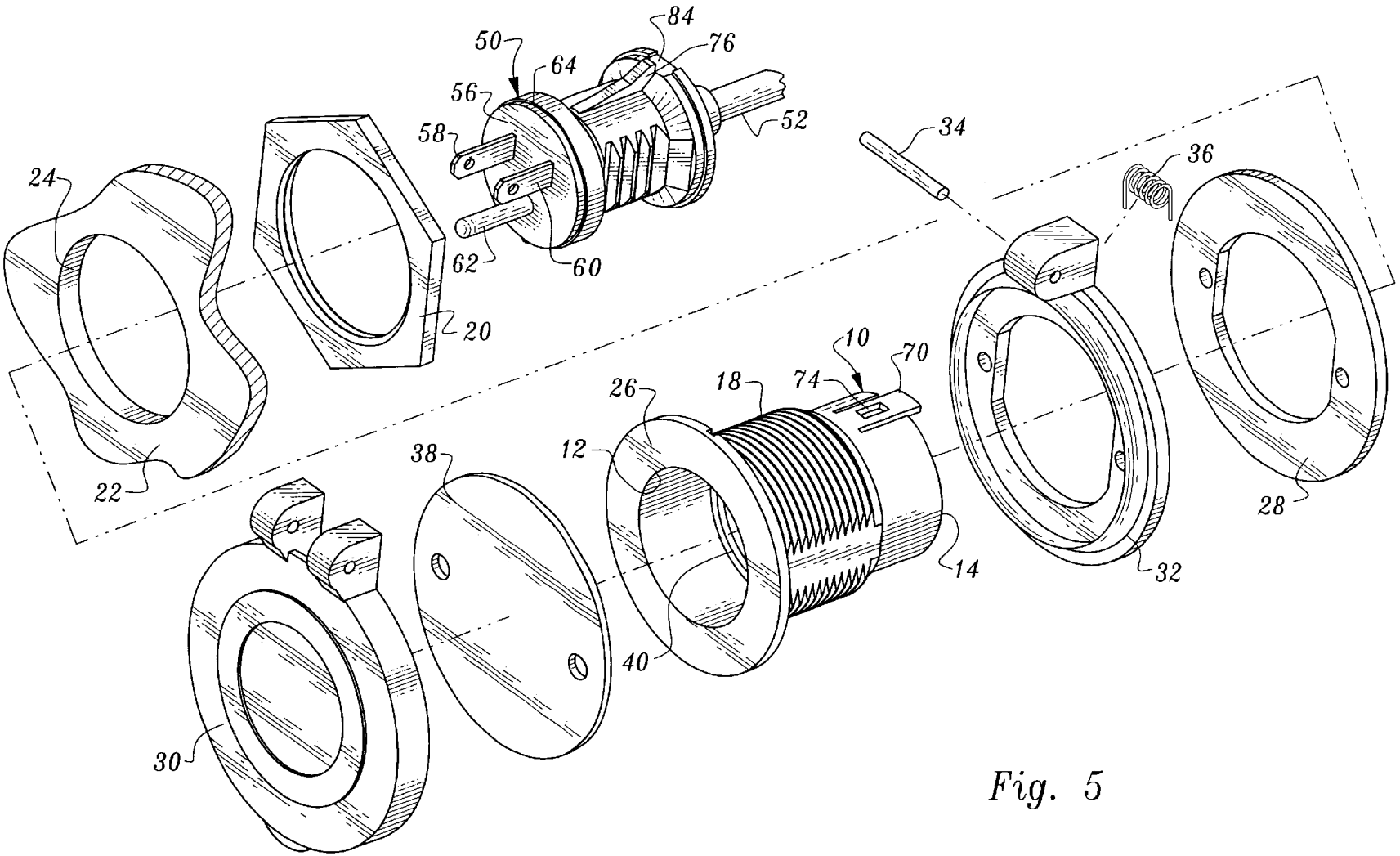
FIG. 5 is an exploded view of the first embodiment of marine on-board charger inlet constructed in accordance with the teachings of the present invention.
Figure 6A:
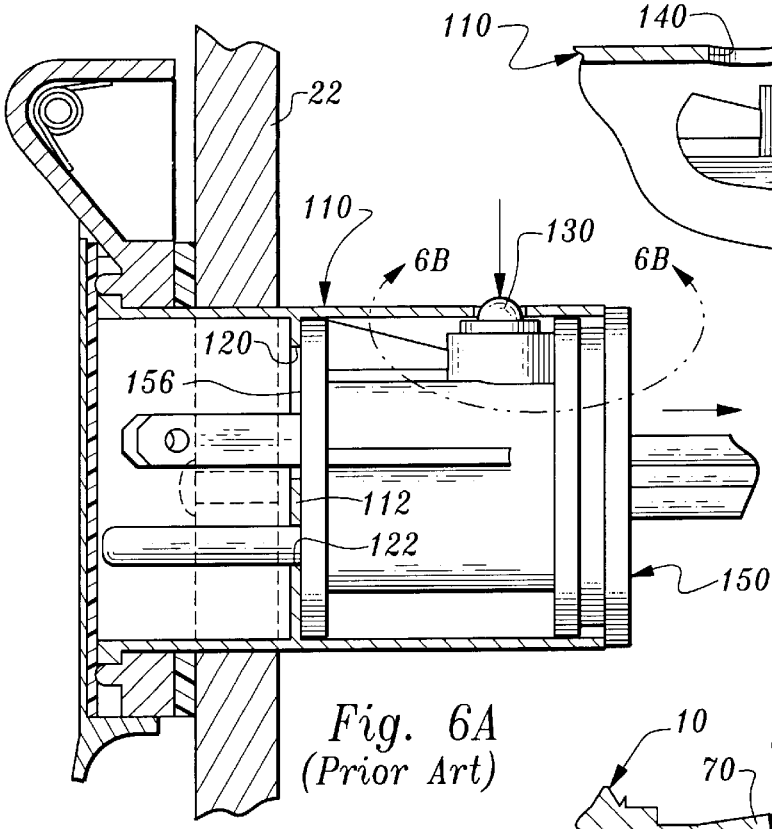
Fig. 6A (Prior Art)
FIG. 6A is a side elevational view illustrating a plug of the type employed in the prior art unit of FIG. 1 inserted in the housing thereof, the latter and other related components being shown in cross-section.
Figure 6B:
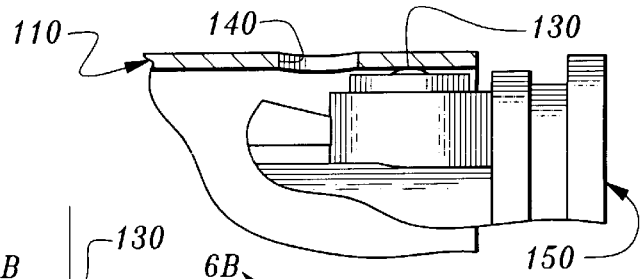
Fig. 6B (Prior Art)
FIG. 6B is an enlarged, sectional view of that portion of the prior art unit delineated by double-headed arrow 6B—6B in FIG. 6A.

FIG. 3 illustrates an alternative embodiment of the invention wherein no cover assembly is utilized in association with the housing, the latter designated by reference numeral 10A. Also, in this instance, the outside of the housing 10A is free of screw threads. This embodiment may be secured to a bulkhead or other structure by threaded screws or other threaded fasteners (not shown) passing through openings 84 in the flange 26A of housing 10A.

FIGS. 1, 4, 6A and 6B illustrate a conventional marine on-board charger inlet. Certain of the components thereof are the same or similar to certain of the components of the present invention. In the prior art approach, housing 110 has an inner partition or wall 112 which is directly engaged by the planar front end 156 of the plug 150. The electrical prongs of plug 150 pass through openings formed in the partition, two such openings, openings 120 and 122, being illustrated in FIG. 6A. In order for the prongs to be of sufficient length to cooperate with an electrical receptacle, they must be longer than conventional electrical prongs. That is, the prongs of plug 150 must be of a length equal to the conventional length of electrical prongs plus the thickness of the partition or wall 122. This means that the prongs will be too long for the plug 150 to be utilized as a conventional electrical plug.

Another deficiency of the prior art arrangement is that it employs a metal, biased lock ball 130 which is located in an opening 140 formed in housing 110 to releasably retain the plug 150 in place. The spring biased locking ball 130 and the metal spring itself are subject to corrosion which can cause the locking arrangement to be partially or wholly inoperative. In any event, because of the relatively small size of opening 140, a user's finger can be prevented from depressing the lock ball 130 far enough to enable it to be removed from the housing 110.

The invention claimed is:

1. A marine on-board charger inlet comprising, in combination:

a housing having first and second housing open ends and a cylindrically-shaped inner wall defining a housing interior extending between said first and second housing open ends;

a circular-shaped rib attached to said housing and extending inwardly from said cylindrically-shaped inner wall into said housing interior at a location spaced from both said first housing open end and said second housing open end and between said first and second housing open ends, said circular-shaped rib having a planar outer rib surface oriented toward said second housing open end, and said housing interior unobstructed between said circular-shaped rib and said second housing open end;

an electrical plug including a plug body having a planar front end, electrical prongs projecting from said planar front end and a rear, outwardly projecting flange, said plug body projecting into said first housing open end, said plug body having a circular-shaped recess adjoining and extending rearwardly from said planar front end receiving the circular-shaped rib and cooperable therewith to prevent movement of said electrical plug in the direction of said second housing open end, said plug body having an outer peripheral plug body surface in frictional engagement with the cylindrically-shaped inner wall of said housing at locations on said outer peripheral plug body surface adjacent to said circular-shaped recess and adjacent to said rear flange, said electrical prongs positioned within said housing interior and spaced inwardly from said cylindrically-shaped inner wall and inwardly of both said first housing opening end and said second housing open end, said planar front end of said plug body aligned with said planar outer rib surface and unobstructed by said housing, said circular-shaped recess and said circular-shaped rib being of equal dimension in the axial direction of said marine on-board charger unit; and lock means releasably locking said plug body in engagement with said circular-shaped rib and retaining said electrical plug at a predetermined position and orientation in said housing, said lock means comprising a deformable lock tab having an elastic memory, said lock tab being integral with said housing and having a distal lock tab end projecting rearwardly beyond the rear flange, said lock tab defining a lock tab opening adjacent to said distal tab end, and said electrical plug including an integral detent projecting outwardly from said plug body and releasably retained in said opening, said detent including a lock detent wall lockingly engaging said lock tab and located within said opening and an inclined detent wall adjacent to said lock detent wall and angularly disposed relative thereto for engaging said lock tab and deflecting the distal lock tab end outwardly away from said housing when said plug and said housing are in engagement and moved toward one another to provide an interconnection therebetween, said rear, outwardly projecting flange covering said first housing open end and defining said detent.

* * * * *